US007375285B2

(12) United States Patent
Chiang

(10) Patent No.: US 7,375,285 B2
(45) Date of Patent: May 20, 2008

(54) SIGNAL TRANSMISSION CABLE

(75) Inventor: Kuo-Wei Chiang, Shenzhen (CN)

(73) Assignee: Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/309,728

(22) Filed: Sep. 15, 2006

(65) Prior Publication Data

US 2007/0251717 A1 Nov. 1, 2007

(30) Foreign Application Priority Data

Apr. 28, 2006 (TW) ..... 95115291 A

(51) Int. Cl.
*H01B 11/02* (2006.01)

(52) U.S. Cl. ..... 174/113 R

(58) Field of Classification Search ..... 174/113 R, 174/78; 439/501

See application file for complete search history.

(56) References Cited

U.S. PATENT DOCUMENTS 5,384,429 A * 1/1995 Bulson et al. ..... 174/102 R
6,780,047 B1 * 8/2004 Laity et al. ..... 439/501
7,015,398 B2 3/2006 Vexler et al.

* cited by examiner

*Primary Examiner*—Chau N. Nguyen
(74) *Attorney, Agent, or Firm*—Wei Te Chung

(57) ABSTRACT

A transmission cable includes a cable (20) and a plug (10). The cable includes a communication line (22), a power line (26), a plurality of inner jackets, an outer jacket wrapping the communication line and the power line together, and a metallic jacket for wrapping the communication line. The power line includes a plurality of power conductors, and each of the power conductors is wrapped by one of the inner jackets. The communication line includes a plurality of communication conductors, and each of the communication conductors is wrapped by one of the inner jackets. The plug includes a shell (12), a socket (14) and a plurality of pins (16) disposed in the socket. Each of the communication conductors electrically connects with one of the pins respectively, one of the power conductors electrically connects with pins of the remaining pins, and the metallic jacket is electrically connected to the shell.

10 Claims, 5 Drawing Sheets

SIGNAL TRANSMISSION CABLE

FIELD OF THE INVENTION

The present invention pertains to a signal transmission cable, and particularly to a transmission cable that transmits both electric power and communication signals.

DESCRIPTION OF RELATED ART

With development of communication technology, communication products are widely used with more and more cables electrically connected to communication devices and power supplies for transmitting communication signals and electric power. Often, the cables are arranged loosely in the communication product wasting space possibly impeding dissipation of heat generated by other parts in the communication product.

Therefore, a need exists in the industry to overcome the aforementioned deficiencies and inadequacies.

SUMMARY OF THE INVENTION

In an exemplary embodiment, a signal transmission cable includes a cable and a plug. The cable includes a communication line, a power line, a plurality of inner jackets, and an outer jacket wrapping the communication line and the power line together. Moreover, the cable further includes a metallic jacket for wrapping the communication line. The power line includes a plurality of power conductors, and each of the power conductors is wrapped by one of the inner jackets. The communication line includes a plurality of communication conductors, and each of the communication conductors is wrapped by one of the inner jackets. The plug includes a shell, a socket, and a plurality of pins disposed in the socket. Each of the communication conductors electrically connects with one of the pins respectively, one of the power conductors electrically connects with pins of the remaining pins, and the metallic jacket is electrically connected to the shell.

Other advantages and novel features will become more apparent from the following detailed description when taken in conjunction with the accompanying drawings, in which:

DETAILED DESCRIPTION OF THE INVENTION

Figure 1:
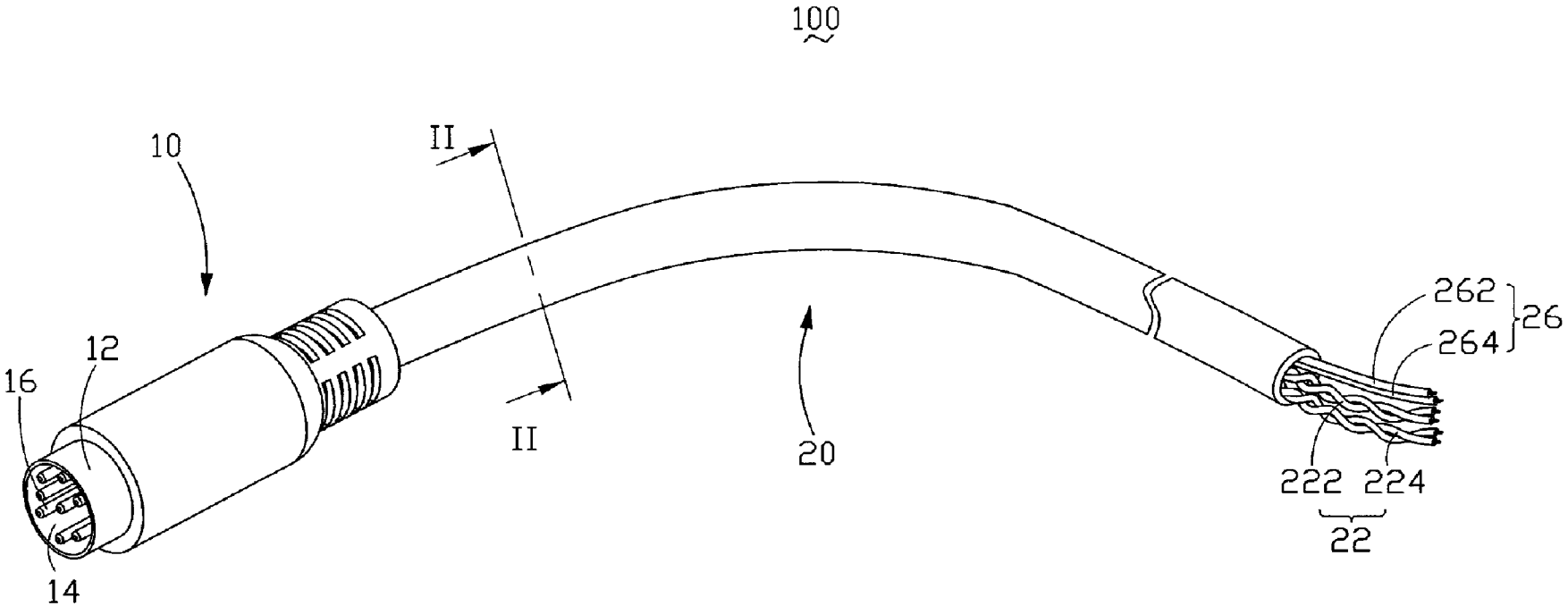
FIG. 1 is a perspective view of a transmission cable of an exemplary embodiment of the present invention.

Referring to FIG. 1, a signal transmission cable 100 of an exemplary embodiment of the present invention is shown. The signal transmission cable 100 comprises a plug 10 and a cable 20. The plug 10 comprises a shell 12 comprising conductive material, a socket 14, and a plurality of pins 16 disposed in the socket 14. In use, the plug 10 is inserted into a socket of a communication product (not shown), and the shell 12 of the plug 10 is grounded in the socket of the communication product.

Figure 2:
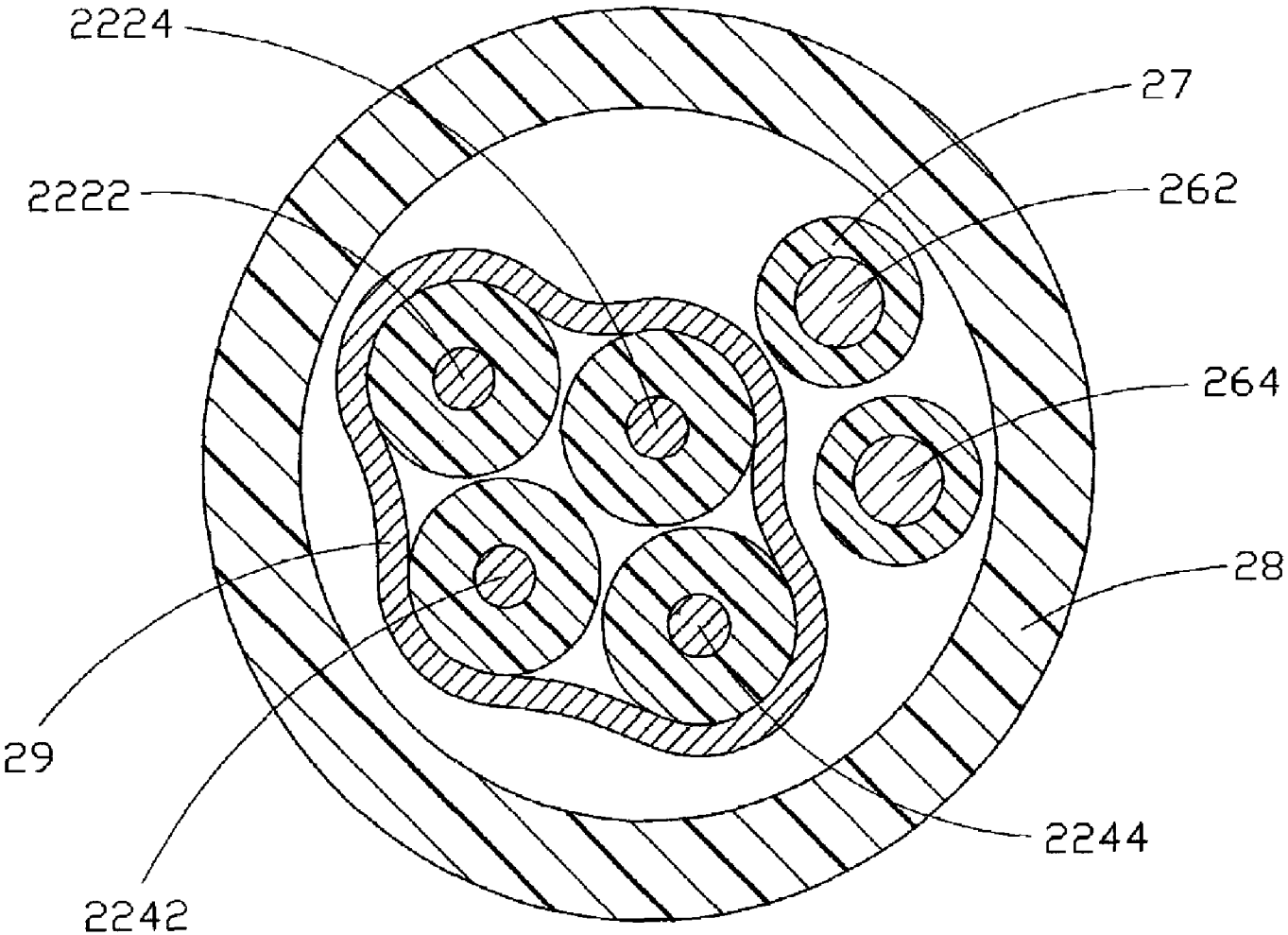
FIG. 2 is a cross-sectional view taken along line II-II of FIG. 1.

Referring also to FIG. 2, the cable 20 comprises an insulating outer jacket 28, a communication line 22 wrapped by a metallic jacket 29 electrically connected to the shell 12 of the plug 10, and a power line 26. The communication line 22 and power line 26 are wrapped together by the outer jacket 28. The communication line 22 comprises an output sub-line 222, and an input sub-line 224. The output sub-line 222 and the input sub-line 224 each comprise a pair of communication conductors for transmitting communication signals. The communication conductors are respectively connected to pins of the plurality of pins 16. In the exemplary embodiment, the metallic jacket 29 comprises aluminum foil.

The output sub-line 222 comprises an anode output conductor 2222 wrapped by an insulating inner jacket 27, and a cathode output conductor 2224 wrapped by the inner jacket 27. The cathode output conductor 2224 and anode output conductor 2222 are twisted to form a twisted pair. The input sub-line 224 comprises an anode input conductor 2242 wrapped by the inner jacket 27, and a cathode input conductor 2244 wrapped by the inner jacket 27. The anode input conductor 2242 and cathode input conductor 2244 are twisted to form another twisted pair. The anode input conductor 2242, cathode input conductor 2244, anode output conductor 2222 and cathode output conductor 2224 are respectively connected with pins of the plurality of pins 16 of the plug 10.

The power line 26 comprises an anode power conductor 262 wrapped by the inner jacket 27, and a cathode power conductor 264 wrapped by the inner jacket 27. In the exemplary embodiment, the anode power conductor 262 and the cathode power conductor 264 are not twisted together. The cathode power conductor 264 is electrically connected to the shell 12 of the plug 10. The anode power conductor 262 is electrically connected to pins of the plurality of pins 16 of the plug 10 not in use by the communication conductors.

In use, via the pins 16 of the plug 10, the cathode output line 2224 and the anode output line 2222 are respectively connected to a cathode fan-out and an anode fan-out of a communication device, and the anode input line 2242 and cathode input line 2244 are respectively connected to an anode fan-in and a cathode fan-in of the communication device. The anode power line 262 and the cathode power line 264 are respectively connected to an anode and a cathode of a power supply (not shown). The plug 10 is inserted into the socket of the communication product, to transmit power and communication signal for the communication product.

Because the shell 12 is grounded in the communication product, the metallic jacket 29 and the cathode power line 264 are grounded when the plug 10 is inserted into the socket of the communication product. Thereby, with aid of the metallic jacket 29, electro magnetic interference (EMI) is reduced. Because the anode power line 262 is connected to the plurality of pins 16, power is transmitted to the communication product via different paths, preventing the communication product from being destroyed by too much current from a single pin. Because the anode communication lines and cathode communication lines are twisted to form twisted pair cables, interference from the communication lines is counteracted.

The transmission cable 100 of the present invention integrates a power line and a communication line to form a multifunctional cable that transmits both communication signals and power, which saves space in the communication product.

Figure 3:
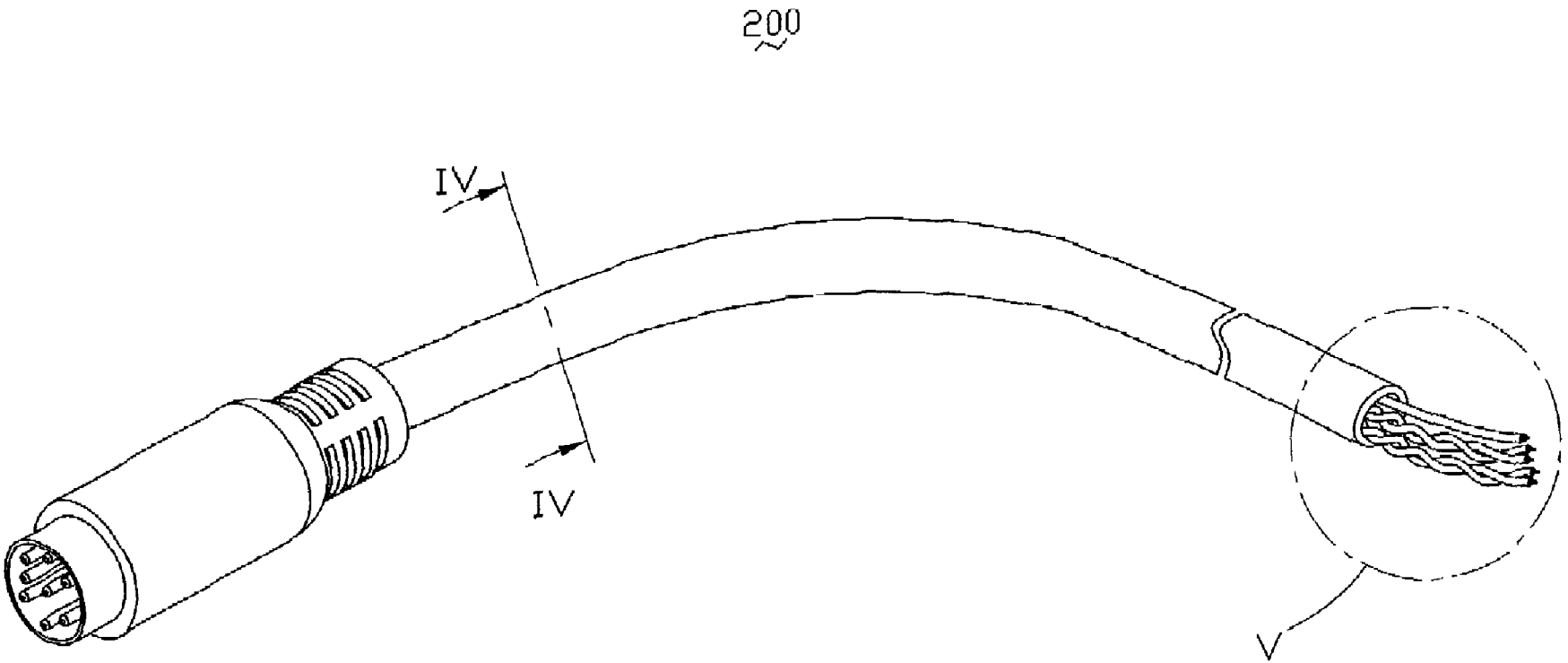
FIG. 3 is a perspective view of a transmission cable of another exemplary embodiment of the present invention.
Figure 4:
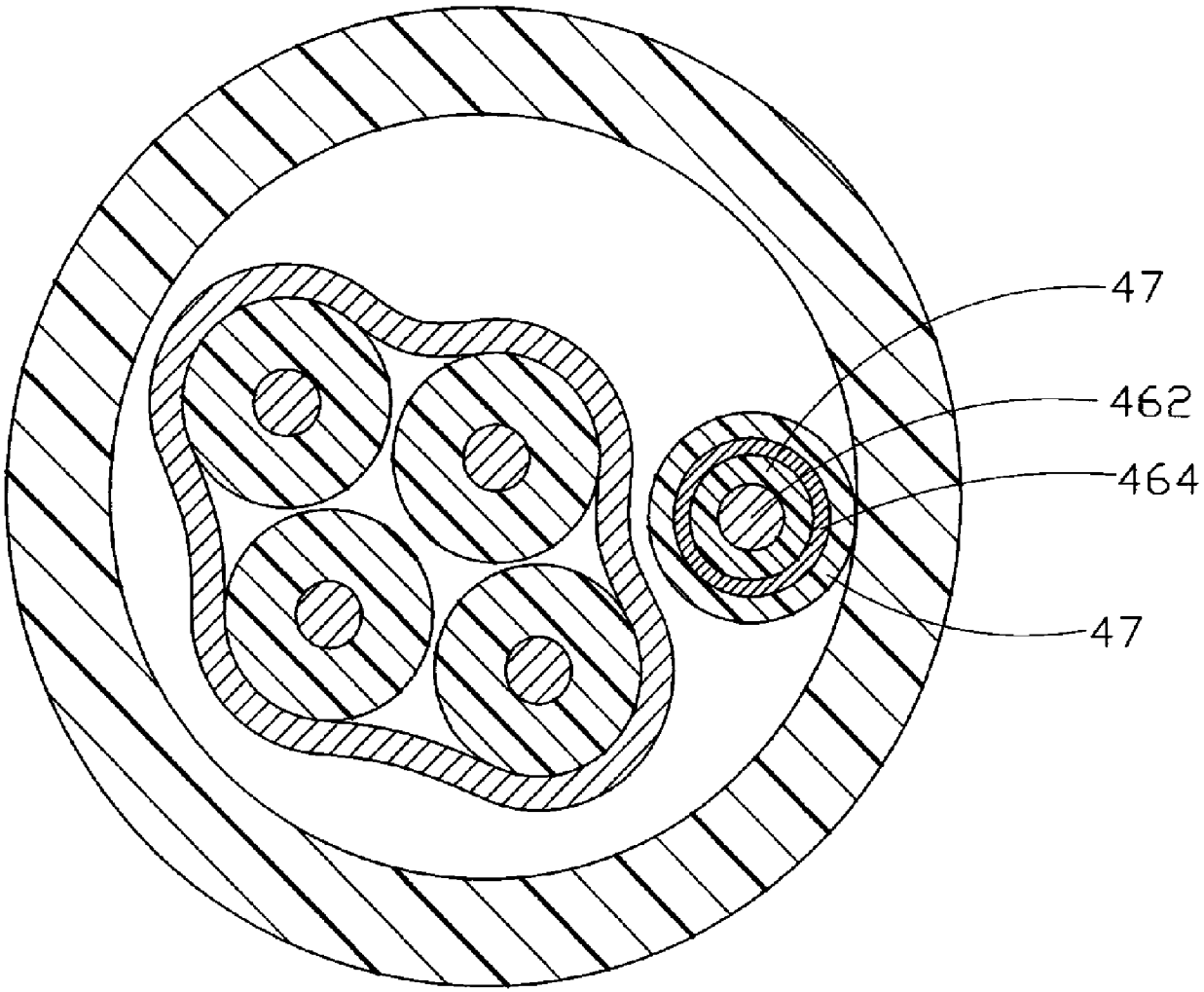
FIG. 4 is a cross-sectional view taken along line IV-IV of FIG. 3.
Figure 5:
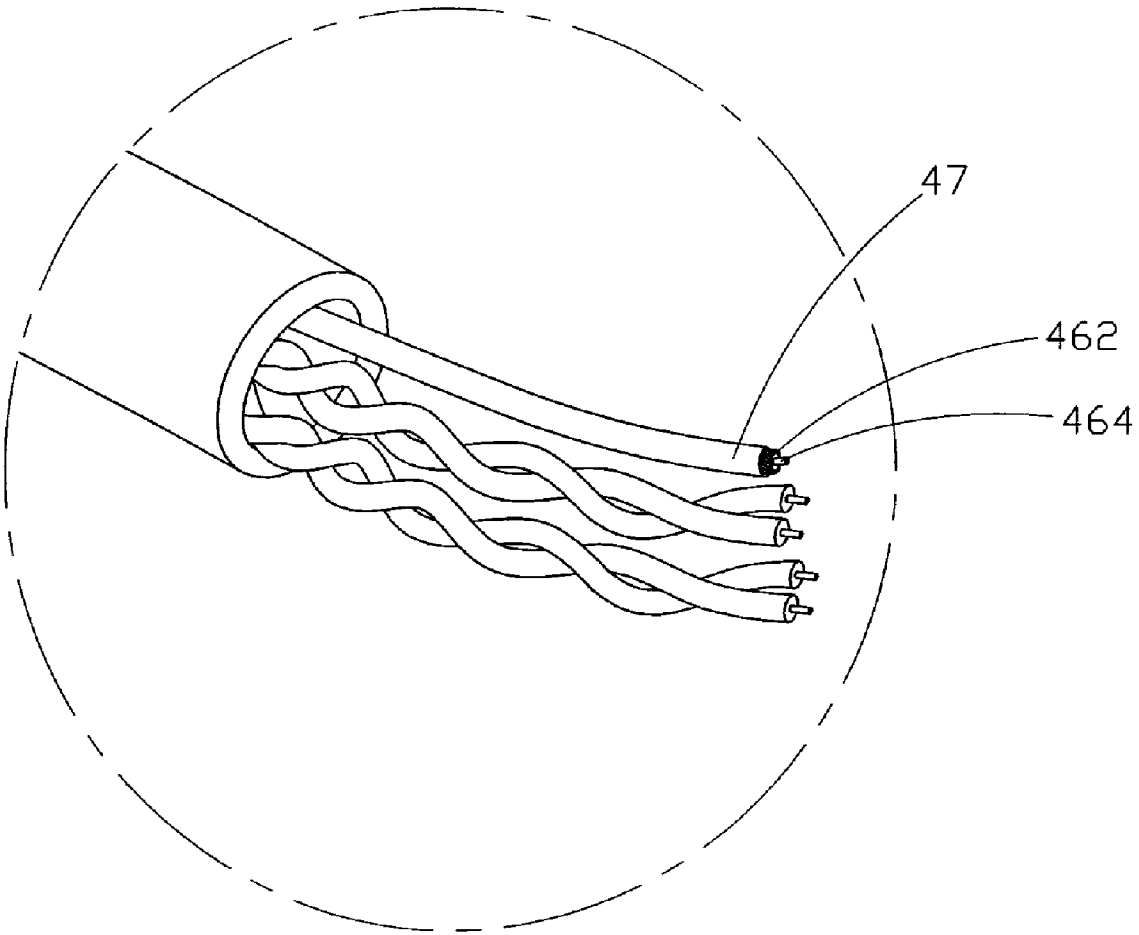
FIG. 5 is an enlarged view of a circled portion V of FIG. 4.

Referring to FIG. 3, a transmission cable 200 of another exemplary embodiment of the present invention is shown. The transmission cable 200 comprises a power line 46 comprising an anode power conductor 462 and a cathode power conductor 464. All elements, construction and function of the exemplary embodiment are the same as the foregoing exemplary embodiment, except that the cathode power conductor 464 is meshed and forms a tube, and the anode power conductor 462 is received in the tube. An inner jacket 47 wraps the anode power conductor 462, and the cathode power conductor 464 and anode power line 462 are wrapped together by another inner jacket 47.

While exemplary embodiments have been described above, it should be understood that they have been presented by way of example only and not by way of limitation. Thus the breadth and scope of the present invention should not be limited by the above-described exemplary embodiment, but should be defined only in accordance with the following claims and their equivalents.

What is claimed is:

1. A transmission cable, comprising:

a cable, comprising a communication line, a power line, a plurality of inner jackets, an outer jacket wrapping the communication line and the power line together, and a metallic jacket for wrapping the communication line, the power line comprising a cathode power conductor and an anode power conductor, each of the power conductors wrapped by one of the inner jackets, the communication line comprising an output sub-line comprising a plurality of output conductors therein, and an input sub-line comprising a plurality of input conductors therein, each of the conductors of the sub-lines wrapped by one of the inner jackets, wherein the cathode power conductor is meshed and forms a tube, and the anode power conductor is received in the tube; and a plug, comprising a shell comprising conductive material, a socket, and a plurality of pins disposed in the socket, wherein each of the conductors of the sub-lines electrically connects with one of the pins respectively, and the anode power conductor is electrically connected to pins of the remaining pins, and the metallic jacket and the cathode power conductor are both electrically connected to the shell.

2. The transmission cable claimed in claim 1, wherein the output sub-line comprises an anode output conductor and a cathode output conductor.

3. The transmission cable claimed in claim 2, wherein the anode output conductor and cathode output conductor are twisted to form a twisted pair cable.

4. The transmission cable claimed in claim 2, wherein the input sub-line comprises an anode input conductor and a cathode input conductor.

5. The transmission cable claimed in claim 4, wherein the anode input conductor and cathode input conductor are twisted to form a twisted pair cable.

6. A communication product, comprising a transmission cable, and the transmission cable comprising:

a cable, comprising a communication line, a power line, a plurality of inner jackets, an outer jacket wrapping the communication line and the power line together, and a metallic jacket for wrapping the communication line, the power line comprising a cathode power conductor and an anode power conductor, each of the power conductors wrapped by one of the inner jackets, the communication line comprising an output sub-line comprising a plurality of output conductors therein, and an input sub-line comprising a plurality of input conductors therein, each of the conductors of the sub-lines wrapped by one of the inner jackets, wherein the cathode power conductor is meshed and forms a tube, and the anode power conductor is received in the tube; and a plug, the plug comprising a shell comprising conductive material, a socket and a plurality of pins disposed in the socket, the shell being grounded in the communication product, wherein each of the conductors of the sub-lines electrically connects with one of the pins respectively, and the anode power conductor is electrically connected to pins of the remaining pins, and the metallic jacket and the cathode power conductor are both electrically connected to the shell.

7. The communication product claimed in claim 6, wherein the output sub-line comprises an anode output conductor and a cathode output conductor.

8. The communication product claimed in claim 7, wherein the anode output conductor and cathode output conductor are twisted to form a twisted pair cable.

9. The communication product claimed in claim 6, wherein the input sub-line comprises an anode input conductor and a cathode input conductor.

10. The communication product claimed in claim 9, wherein the anode input conductor and cathode input conductor are twisted to form a twisted pair cable.

* * * * *